US006827355B2

(12) United States Patent
Soo

(10) Patent No.: US 6,827,355 B2
(45) Date of Patent: Dec. 7, 2004

(54) ADJUSTABLE SKATE

(76) Inventor: Mike Soo, No. 2, Lane 1102, Da-Wan Road, Yong-Kang, Tainan Hsien (TW)

( * ) Notice: Subject to any disclaimer, the term of this patent is extended or adjusted under 35 U.S.C. 154(b) by 72 days.

(21) Appl. No.: 10/314,502

(22) Filed: Dec. 9, 2002

(65) Prior Publication Data

US 2004/0108665 A1 Jun. 10, 2004

(51) Int. Cl.[7] ..... A63C 17/00
(52) U.S. Cl. ..... 280/11.19; 280/11.26
(58) Field of Search ..... 280/11.19, 11.221, 280/11.26, 11.27; 36/97, 115

(56) References Cited

U.S. PATENT DOCUMENTS 1,633,413 A * 6/1927 La Marca ..... 36/91
4,083,128 A * 4/1978 Rossman ..... 36/97
5,224,718 A * 7/1993 Gertler ..... 280/11.19
5,295,701 A * 3/1994 Reiber et al. ..... 280/11.231
5,484,149 A * 1/1996 Lee ..... 280/11.26
5,645,288 A * 7/1997 Lu ..... 280/11.26
5,794,362 A * 8/1998 Polk et al. ..... 36/97
5,836,592 A * 11/1998 Chang ..... 280/11.26
5,931,478 A * 8/1999 Chang ..... 280/11.231
6,050,574 A * 4/2000 Olson et al. ..... 280/11.231
6,217,039 B1 4/2001 Iverson et al.
6,438,872 B1 * 8/2002 Chil et al. ..... 36/97
6,450,510 B1 * 9/2002 Liu ..... 280/11.26
6,547,261 B2 * 4/2003 Gorza et al. ..... 280/11.223

* cited by examiner

*Primary Examiner*—Christopher P. Ellis
*Assistant Examiner*—Christopher Bottorff
(74) *Attorney, Agent, or Firm*—Alan D. Kamrath; Nikolai & Mersereau, P.A.

(57) ABSTRACT

An adjustable skate includes a boot and a liner. The boot includes an upper and a sole, the upper including a toe cap and a heel portion. The liner is mounted in the boot and includes a bottom plate slidably mounted on the sole and a toe box provided on a front end of the bottom plate. A chamber for receiving a foot of a wearer is defined between the toe box of the liner and the heel portion of the boot. A member is formed on the toe box of the liner. An adjusting member is mounted to the toe cap of the boot and engaged with the member on the toe box of the liner. The adjusting member and the member are so configured that rotation of the adjusting member causes the liner to move along a lengthwise direction of the boot.

3 Claims, 4 Drawing Sheets

ADJUSTABLE SKATE

BACKGROUND OF THE INVENTION

1. Field of the Invention

The present invention relates to an adjustable skate. In particular, the present invention relates to an adjustable skate for adjusting a length of a chamber in the boot of the adjustable skate according to different foot lengths of different wearers.

2. Description of the Related Art

Skates, whether with wheels or a blade, are popular among young people. Many skates are adjustable in length and/or width to suit different foot sizes of various wearers. Nevertheless, the adjusting mechanisms of the skates are complicated and thus costly. Further, the adjusting procedures for the adjusting mechanisms are troublesome and time-consuming, as they include detachment of bolts and screws before adjustment as well as reassembling of the bolts and screws after adjustment. It is, therefore, a long and unfulfilled need for a simple adjusting device for the skates without time-consuming procedures for adjustment.

SUMMARY OF THE INVENTION

An object of the present invention is to provide an adjustable skate having a bladder for adjusting a length of a chamber in the boot of the adjustable skate according to different foot lengths of different wearers.

An adjustable skate in accordance with the present invention includes a boor and a liner, The boot includes an upper and a sole, the upper including a toe cap and a heel portion. The liner is mounted in the boot and includes a bottom plate slidably mounted on the sole and a toe box provided on a front end of the bottom plate. A chamber for receiving a foot of a wearer is defined between the toe box of the liner and the heel portion of the boot. A bolt is formed on the toe box of the liner.

An adjusting member is mounted to the toe cap of the boot and engaged with the bolt on the toe box of the liner. The adjusting member and the member are so configured that rotation of the adjusting member causes the liner to move along a lengthwise direction of the boot.

In an embodiment of the invention, the member on the toe box of the liner is a bolt, and the adjusting member includes an end having a screw hole for threadedly engaging with the bolt on the toe box of the liner. The toe cap of the boot includes a hole in a front end thereof. The other end of the adjusting member is received in the hole of the toe cap and drivable by a tool. The other end of the adjusting member rotates idly when the adjusting member is turned.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
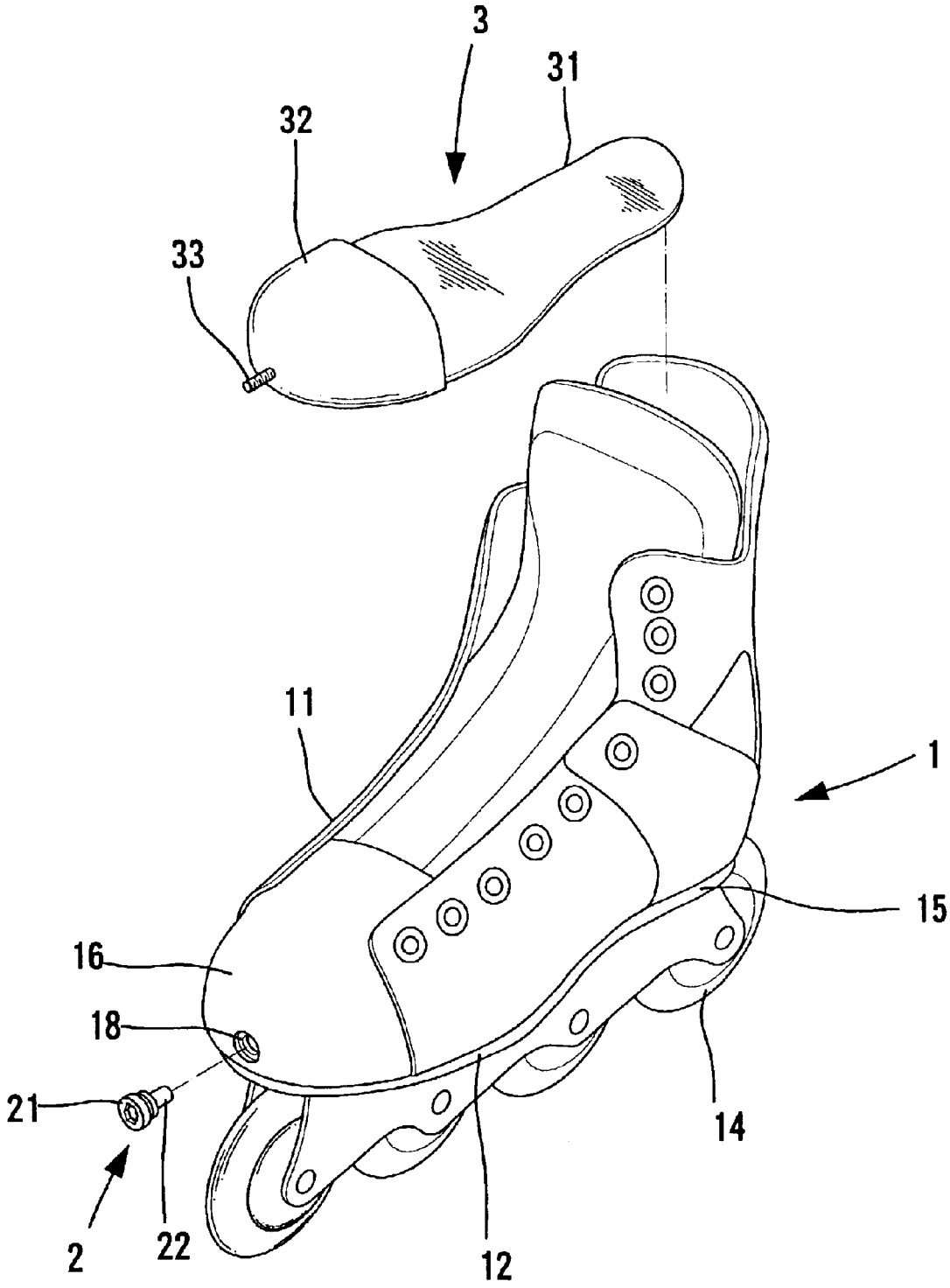
FIG. 1 is a perspective view, partly exploded, of an adjustable skate in accordance with the present invention.
Figure 2:
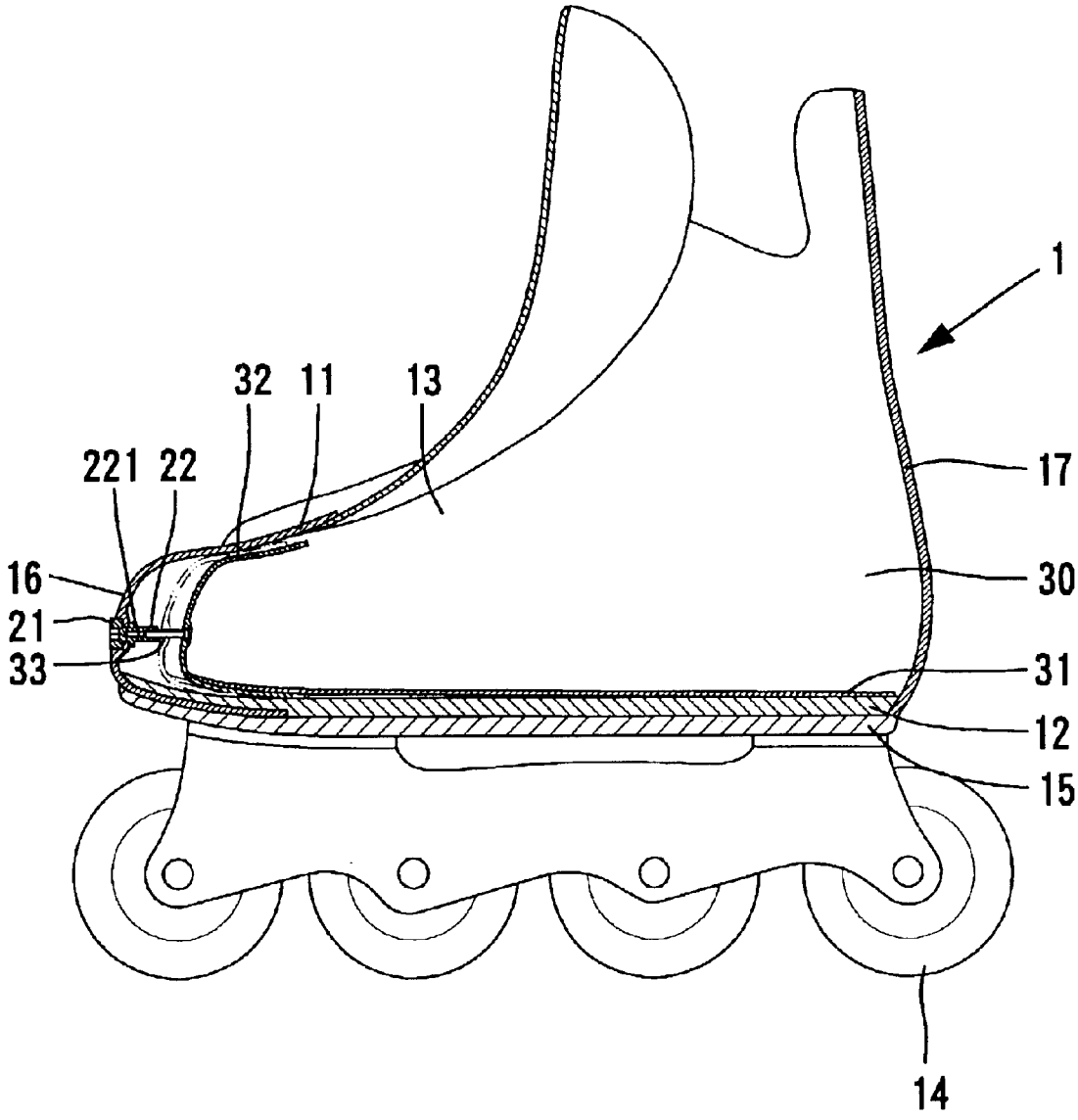
FIG. 2 is a side view, partly sectioned, of the adjustable skate in accordance with the present invention.

Referring to FIGS. 1 and 2, an adjustable skate in accordance with the present invention generally comprises a boot 1, a liner 3, and an adjusting member 2. The boot 1 includes an upper 11 and a sole 12 that are integrally molded from rigid plastics. The upper 11 includes a toe cap 16 and a heel portion 17 between which a compartment 13 is defined. A hole 18 is defined in a front end of the toe cap 16. Mounted below the sole 12 is a base 15 to which wheels or rollers 14 are attached. Of course, the rollers 14 can be replaced with a blade.

The liner 3 is made from rigid plastics and includes a bottom plate 31 on which a foot of a wearer stands. The liner 3 further includes a toe box 32 on a front end of the bottom plate 31. A screw or bolt 33 is formed on a front end of the toe box 32. The toe box 32 is configured approximately the same as the toe cap 16, and the bottom plate 31 is slightly smaller than the sole 12. Thus, the liner 3 is slidable along a lengthwise direction of the boot 1. A chamber 30 is defined between the toe box 32 and the heel portion 17 of the boot 1 for receiving a foot of a wearer.

The adjusting member 2 in this embodiment includes a first end 21 engaged in the bole 18 of the toe cap 16 of the boot 1 and a second end 22 having a screw hole 221 for threadedly engaging with the bolt 33 on the toe box 32 of the liner 3. In this embodiment, the first end 21 of the adjusting member 2 is in the form of a bolt head for engaging with a tool. Thus, as illustrated in FIG. 4, a hexagonal wrench 4 or the like may be engaged with the first end 21 of the adjusting member 2. The first end 21 of the adjusting member 2 rotates idly in the hole 18 of the toe cap 16 of the boot I, yet the position of the liner 3 is changed due to threading engagement between the screw hole 221 of the adjusting member 22 and the bolt 33 on the toe box 32 of the liner 3, as shown in FIG. 3.

Figure 3:
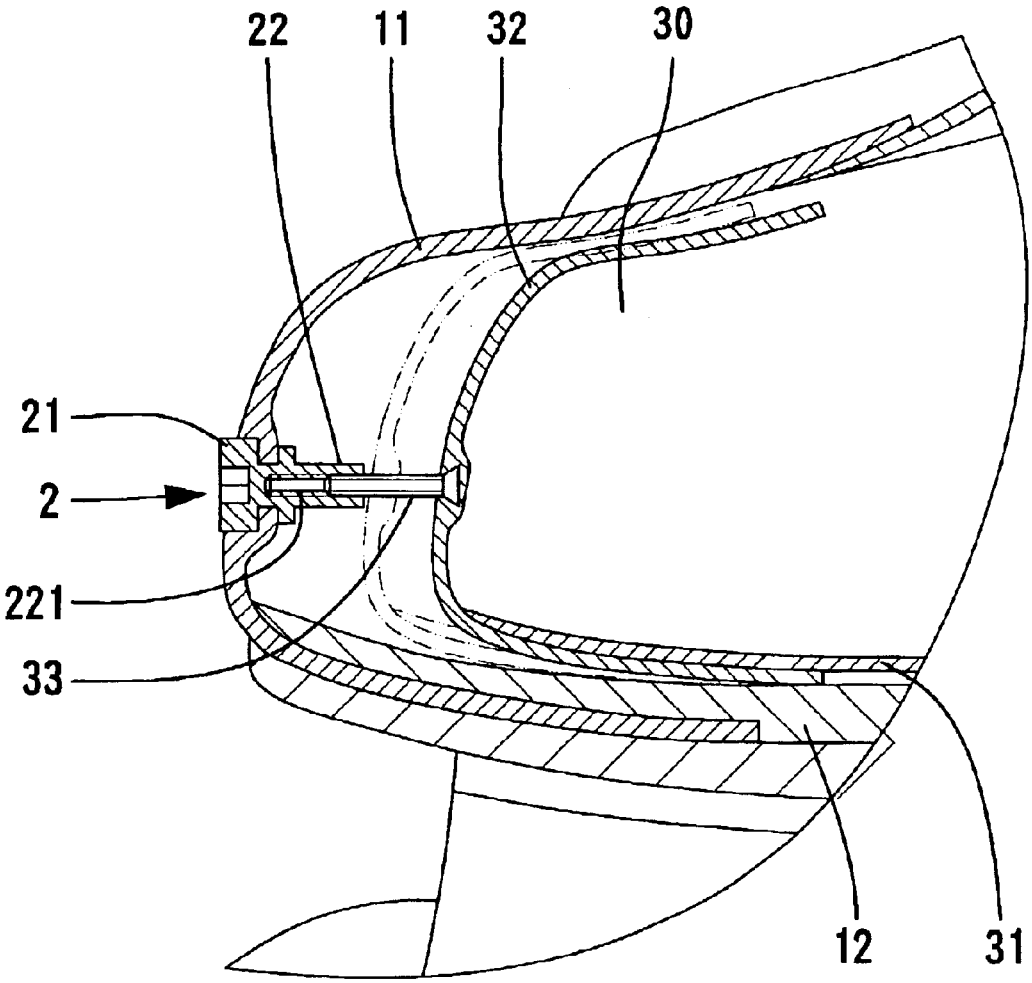
FIG. 3 is an enlarged view of a front portion of the adjustable skate in FIG. 2, illustrating adjustment of the adjustable skate in accordance with the present invention.
Figure 4:
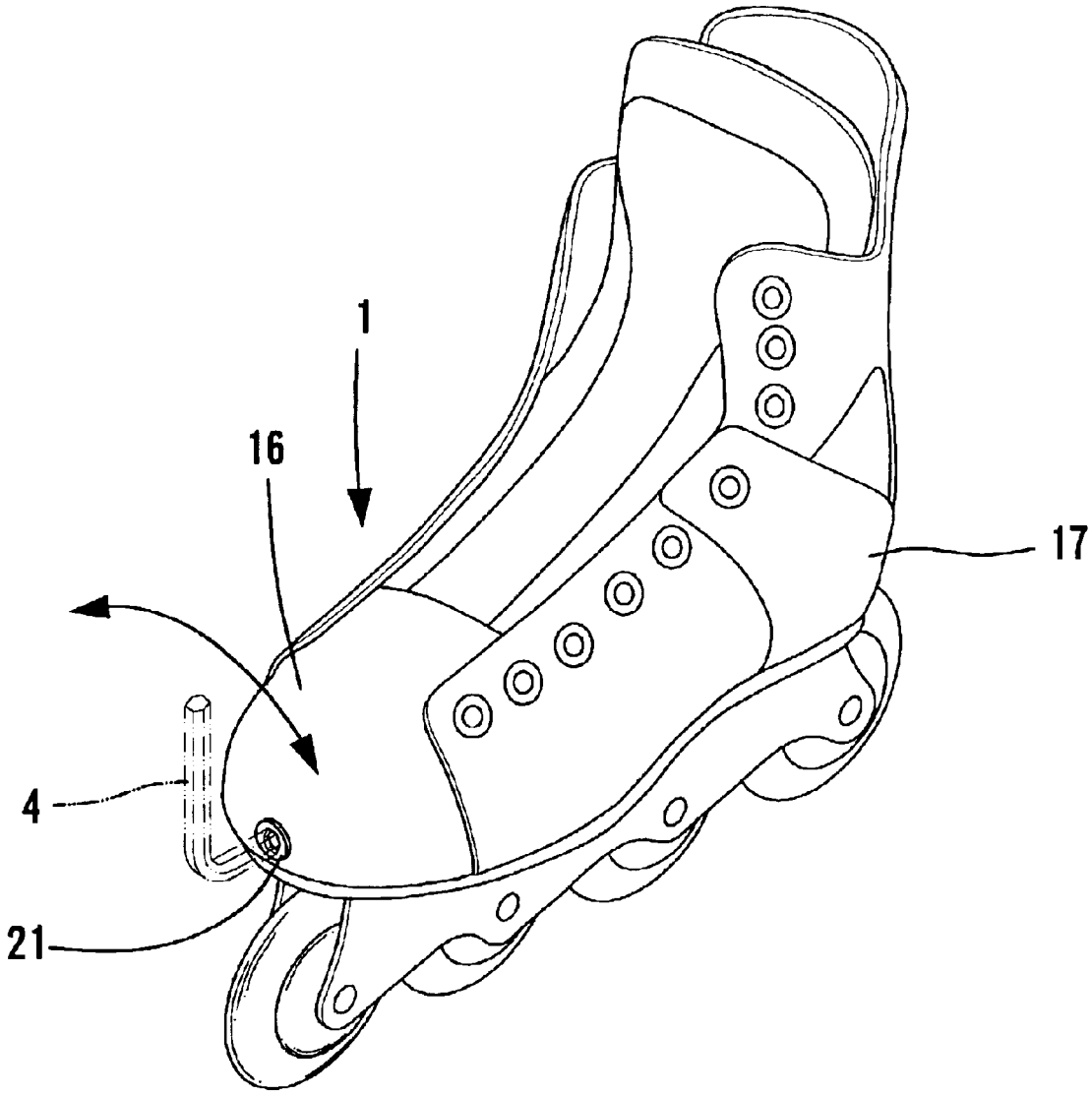
FIG. 4 is a perspective view illustrating adjustment of the adjustable skate in accordance with the present invention.

In use, as illustrated in FIG. 3, if the wearer feels the chamber 30 is too small for his or her feet, the wearer may turn the adjusting member 2 with a suitable tool (a hexagonal wrench 4 in FIG. 4 or other suitable tool) to move the liner 3 in the lengthwise direction of the boot 1. The liner 3 is moved from a position shown by the solid lines to another position shown in phantom lines. Thus, the overall length of the chamber 30 receiving the foot of the wearer is increased. On the other hand, if the wearer feels the chamber 30 is too small for his or her feet, the wearer may turn the adjusting member 2 in a reverse direction to move the liner 3 to the desired position. The adjusting procedure is significantly simplified when compared with conventional designs.

Although the invention has been explained in relation to its preferred embodiment, it is to be understood that many other possible modifications and variations can be made without departing from the scope of the invention as hereinafter claimed.

What is claimed is:

1. An adjustable skate comprising:

a boot including an upper and a sole, the upper including a toe cap and a heel portion, the toe cap of the boot including a hole in a front end thereof;

a liner mounted in the boot, the liner including a bottom plate slidably mounted on the sole and a toe box on a front end of the bottom plate, a chamber for receiving a foot of a wearer being defined between the toe box of the liner and the heel portion of the boot, a bolt being formed and fixed on the toe box of the liner; and an adjusting member mounted to the toe cap of the boot, the adjusting member including a first end rotatably received in the hole of the toe cap, the adjusting member including a second end having a screw hole for threadedly engaging with the bolt on the toe box of the liner, the first end of the adjusting member being axially fixed and rotating idly when the adjusting member is turned, with the liner moving along a lengthwise direction of the boot when the adjusting member is turned.

2. The adjusting skate as claimed in claim 1, wherein the first end of the adjusting member is drivable by a tool.

3. The adjustable skate as claimed in claim 1, wherein the liner is made from rigid plastics.

* * * * *